US008602516B2

(12) United States Patent
Hamada

(10) Patent No.: US 8,602,516 B2
(45) Date of Patent: Dec. 10, 2013

(54) IMAGE RECORDING DEVICE AND METHOD FOR CONTROLLING IMAGE RECORDING DEVICE

(75) Inventor: Yusuke Hamada, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 262 days.

(21) Appl. No.: 13/270,389

(22) Filed: Oct. 11, 2011

(65) Prior Publication Data

US 2012/0092407 A1 Apr. 19, 2012

(30) Foreign Application Priority Data

Oct. 18, 2010 (JP) ..... 2010-233404

(51) Int. Cl.
*B41J 29/38* (2006.01)

(52) U.S. Cl.
USPC ..... 347/14; 347/16

(58) Field of Classification Search
USPC ..... 347/14, 16, 19, 21, 101, 104, 105
See application file for complete search history.

(56) References Cited

U.S. PATENT DOCUMENTS 6,788,323 B2 * 9/2004 Enomoto et al. ..... 347/177

FOREIGN PATENT DOCUMENTS

| | | | |
|---|---|---|---|
| EP | 0 763 784 | B1 | 11/2001 |
| JP | 9-136741 | A | 5/1997 |
| JP | 2006-044101 | A | 2/2006 |
| JP | 2006-126326 | A | 5/2006 |

* cited by examiner

*Primary Examiner* — Juanita D Jackson
(74) *Attorney, Agent, or Firm* — Holtz, Holtz, Goodman & Chick, PC

(57) ABSTRACT

The present invention provides an image recording device including: a conveyance mechanism moving a record medium in a first direction; a recording unit having a recording device arranged in a second direction crossing the first direction in which the record medium moves; a side end detection unit detecting in a desired period a side end position in the second direction of the record medium which moves in the first direction; a storage unit storing detection results of the side end position; and a side end position determination unit reading the plurality of continuous detection results from the storage unit, and determining as the side end position of the record medium an average value of the detection results remaining after excluding at least one detection result indicating the side end position at a relatively outside a central portion of the record medium from the plurality of read detection results.

9 Claims, 9 Drawing Sheets

60

60A 60L 60R

| ADDRESS | SIDE END POSITION DETECTION RESULT | |
|---|---|---|
| | LEFT END | RIGHT END |
| 100 | 0 | 0 |
| 99 | 0 | 0 |
| 98 | 0 | 0 |
| 97 | * 385 | * 1620 |
| 96 | 400 | 1600 |
| 95 | 400 | 1600 |
| 94 | * 388 | 1600 |
| 93 | 400 | 1600 |
| 92 | 400 | * 1610 |
| 91 | * 379 | 1600 |
| 90 | 400 | 1600 |
| ・・・ | ・・・ | ・・・ |
| ・・・ | ・・・ | ・・・ |
| 10 | 400 | * 1620 |
| 9 | 400 | 1600 |
| 8 | * 392 | 1600 |
| 7 | 400 | * 1613 |
| 6 | 400 | 1600 |
| 5 | * 390 | 1600 |
| 4 | 400 | * 1615 |
| 3 | 400 | 1600 |
| 2 | 0 | 0 |
| 1 | 0 | 0 |
| 0 | 0 | 0 |

FIG. 6

IMAGE RECORDING DEVICE AND METHOD FOR CONTROLLING IMAGE RECORDING DEVICE

CROSS-REFERENCE TO RELATED APPLICATIONS

This application is based upon and claims the benefit of priority of the prior Japanese Patent Application No. 2010-233404, filed on Oct. 18, 2010, the entire contents of which are incorporated herein by reference.

BACKGROUND OF THE INVENTION

1. Field of the Invention

The present invention relates to an image recording device and a method for controlling the image recording device.

2. Description of the Related Art

Generally, an image recording device represented by a printer and a copying machine conveys a record medium, and records an image during the conveyance. For example, in the image forming device in the ink jet system, ink is jetted from the head nozzle of the ink head to the medium (for example, printer paper) conveyed by the conveying unit such as a platen etc. to record an image (recording process).

When an image is recorded, although a fed medium is displaced in the direction (main scanning direction) orthogonal to the direction of conveyance (subscanning direction), the ink is not jetted to the conveying system exposed outside the medium as spots. Therefore, the position of the side end portion of the medium is to be correctly detected.

To detect a side end portion, an image sensor, an optical line sensor, etc. are generally used. In the detection using such a light receiving element, the end position of a medium is determined by the level difference of the reflected light from the medium and the member (for example, a conveying belt) which supports the medium.

For example, the patent document 1 discloses the end position detecting method for emitting light to recording paper and detecting the end position of the recording paper based on the quantity of light reflected from the recording paper. The method includes: a step of storing the quantity of reflected light from a recording paper guide device; a step of advancing the recording paper to detect the quantity of reflected light of the recording paper, and calculating the difference from the quantity of reflected light of the medium guide device; a step of multiplying the difference by a value of C exceeding 0 and smaller than 1 to set a reference level; a step of returning the recording paper to the downstream at the position where the reflected light of the recording paper guide device can be detected; and the step of determining that the starting point of the recording paper has reached the reference position at the point where the quantity of reflected light has reached the reference level after advancing the recording paper.

[Patent Document 1] Japanese Laid-open Patent Publication No. 09-136741

SUMMARY OF THE INVENTION

In the technology of the patent document 1 above, it is assumed that the quantity of reflected light of each of the medium guide device and the recording paper is constant.

However, when any image such as hemming and ground patterns etc. are formed and images on the reverse are visible, the images etc. may change the output level of light receiving elements, thereby causing misdetection the changed point as the end position of the recording paper.

Furthermore, for example, when there are a number of holes in the conveying belt as a medium guide device and there is a reflecting object below the conveying belt immediately below the side end detection unit, and when there are spots on the conveying belt, the reflected light from the holes, spots, etc. of the conveying belt may cause misdetection of the portion other than the end position of the recording paper as an end position.

In addition, in the case of the patent document 1, it is necessary to have a step of returning the repo to have a step of returning the recording paper in the reverse direction to the direction of conveyance, and in the case of the conveyance mechanism based on the movement of recording paper only in the direction of conveyance, it is hard to displace the recording paper in the direction of the width, and it is also anticipated that it is hard to apply the technique to the detection of the side end position of the recording paper in the direction of the width.

The present invention aims at providing the technology capable of correctly determining the side end position of a medium without an influence of the state of the record medium and a conveyance mechanism.

The first aspect of the present invention provides an image recording device including:

a conveyance mechanism for moving a record medium in a first direction;

a recording unit having a recording device arranged in a second direction crossing the first direction in which the record medium moves;

a side end detection unit for detecting in a desired period a side end position in the second direction of the record medium which moves in the first direction;

a storage unit for storing a plurality of detection results of the side end position acquired by the side end detection unit; and a side end position determination unit for reading the plurality of continuous detection results from the storage unit, and determining as the side end position of the record medium an average value of the detection results remaining after excluding at least one detection result indicating the side end position at a relatively outside a central portion of the record medium from the plurality of read detection results.

The second aspect of the present invention provides a method of controlling an image recording device having a conveyance mechanism for moving a record medium in a first direction and a recording device arranged in a second direction crossing the first direction in which the record medium moves, and the method includes:

a first step of detecting at a desired period a side end position in the second direction of the record medium moving in the first direction;

a second step of storing a plurality of detection results of the side end position acquired in the first step; and a third step of reading the plurality of continuous detection results from the plurality of detection results stored in the second step, and determining as the side end position of the record medium an average value of the detection results remaining after excluding at least one detection result indicating the side end position at a relatively outside a central portion of the record medium from the plurality of read detection results.

The third aspect of the present invention provides a non-transitory storage medium storing a control program of an image recording device having a conveyance mechanism for moving a record medium in a first direction and a recording device arranged in a second direction crossing the first direction in which the record medium moves. The control program is used to direct a computer to perform:

a first step of detecting at a desired period a side end position in the second direction of the record medium moving in the first direction;

a second step of storing a plurality of detection results of the side end position acquired in the first step; and a third step of reading the plurality of continuous detection results from the plurality of detection results stored in the second step, and determining as the side end position of the record medium an average value of the detection results remaining after excluding at least one detection result indicating the side end position at a relatively outside a central portion of the record medium from the plurality of read detection results.

The fourth aspect of the present invention provides a side end position recognition device of a record medium including:

a side end detection unit for detecting in a desired period a side end position in a second direction crossing a first direction of a record medium which moves in the first direction by a conveyance mechanism;

a storage unit storing a plurality of detection results of the side end positions acquired by the side end detection unit; and a side end position determination unit for reading the plurality of continuous detection results from the storage unit, and determining as the side end position of the record medium an average value of the detection results remaining after excluding at least one detection result indicating the side end position at a relatively outside a central portion of the record medium from the plurality of read detection results.

The fifth aspect of the present invention provides a side end position recognition method for a record medium including:

a first step of detecting in a desired period a side end position in a second direction crossing a first direction in the record medium which moves in the first direction;

a second step of storing a plurality of detection results of the side end position acquired in the first step; and a third step of reading the plurality of continuous detection results from the plurality of detection results stored in the second step, and determining as the side end position of the record medium an average value of the detection results remaining after excluding at least one detection result indicating the side end position at a relatively outside a central portion of the record medium from the plurality of read detection results.

The present invention can provide the technology of correctly determining the side end position of a record medium without an influence of the state of the record medium or conveyance mechanism.

BRIEF DESCRIPTION OF THE DRAWINGS

FIG. 6 illustrates the concept of an example of the configuration of the control table in the image recording device according to an embodiment of the present invention.

DESCRIPTION OF THE PREFERRED EMBODIMENTS

The embodiments of the present invention are described below in detail with reference to the attached drawings.

Figure 1:
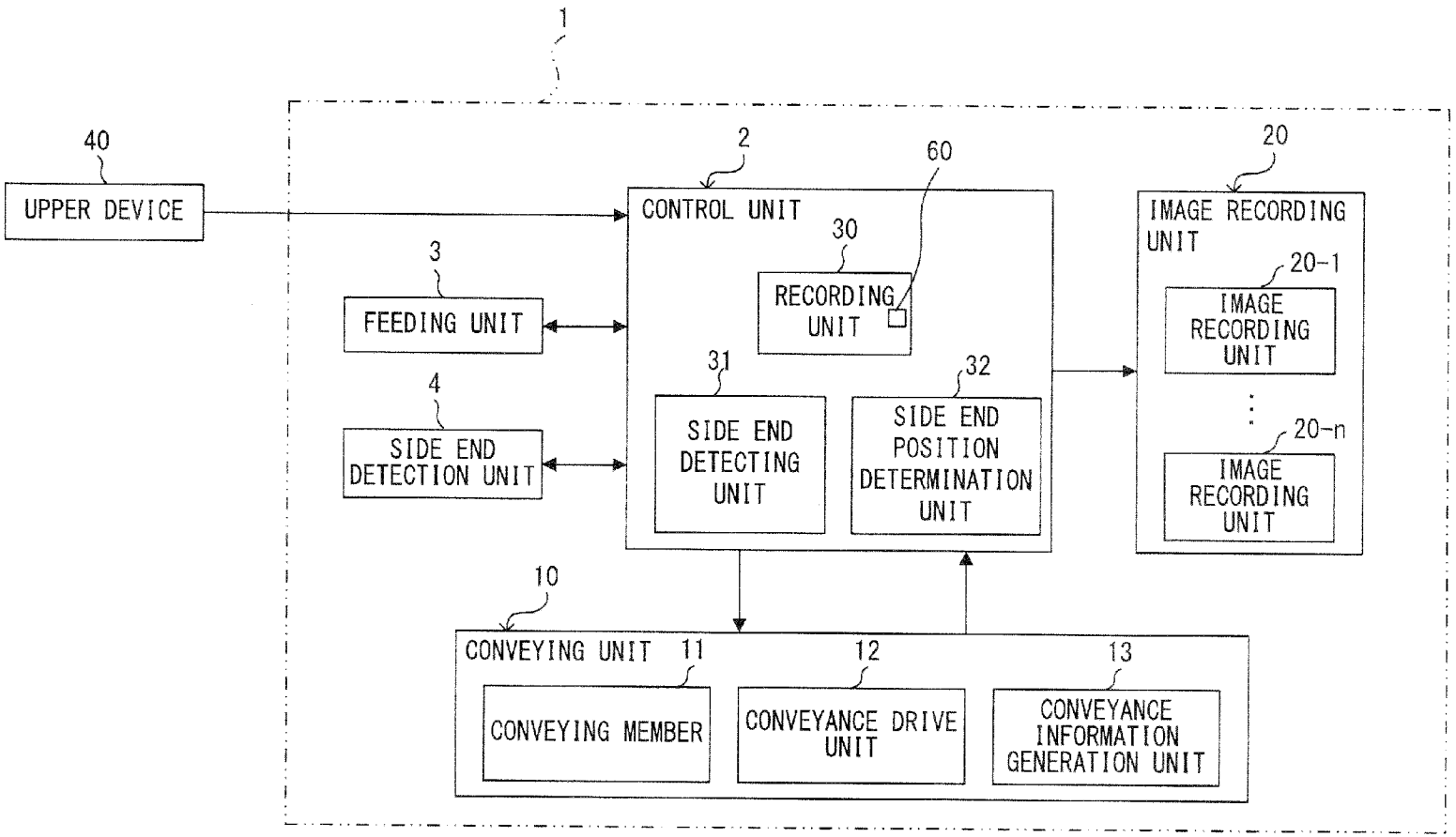
FIG. 1 is a block diagram of the concept of an example of the configuration of an image recording device embodying the control method as an embodiment of the present invention.
Figure 2A:
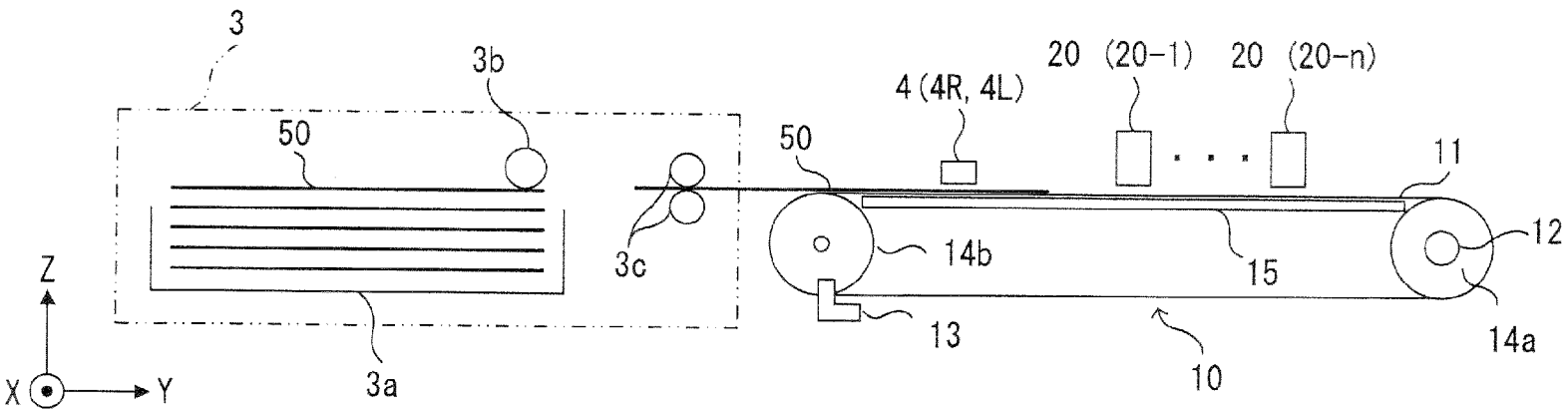
FIG. 2A is a schematic diagram of a side view of an example of the entire structure of the image recording device according to an embodiment of the present invention.
Figure 2B:
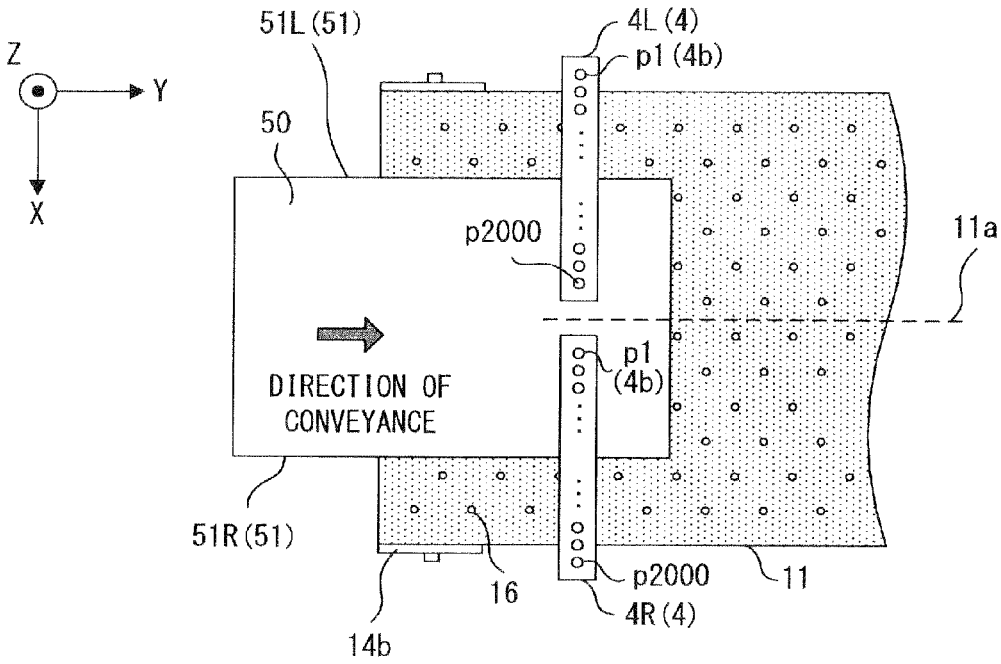
FIG. 2B is a plan view exemplifying the side end position detection unit in the image recording device according to an embodiment of the present invention.

FIG. 1 is a block diagram of the concept of an example of the configuration of an image recording device embodying the control method as an embodiment of the present invention. FIG. 2A is a schematic diagram of a side view of an example of the entire structure of the image recording device according to an embodiment of the present invention. FIG. 2B is a plan view exemplifying the side end position detection unit in the image recording device according to an embodiment of the present invention.

The arrows illustrated in FIGS. 2A and 2B indicate that the X-axis direction is the main scanning direction (second direction), the Y-axis direction is the subscanning direction (first direction), and the Z-axis direction is the direction orthogonal to the X-Y plane.

An image recording device 1 according to the present embodiment includes at least a feeding unit 3 provided at the most upstream side to the conveying path of a record medium 50, a conveying unit 10 provided at the downstream side of the conveying path of the feeding unit 3, an image recording unit 20 (recording unit) provided at the downstream side of the conveying path of the side end detection unit 4 with respect to the side end detection unit 4 opposite and above the conveying unit 10, and a control unit 2 for generally controlling the entire image recording device 1 for realizing the operating process according to the present embodiment described later.

The feeding unit 3 includes at least one feeding tray 3*a* for stacking and storing a plurality of record media 50, a feeding mechanism 3*b* provided above the feeding tray 3*a*, a registration roller pair 3*c* provided at the downstream side of the conveying path of the feeding mechanism 3*b*.

At an instruction of the control unit 2, the feeding unit 3 feeds the record medium 50 stacked and stored in the feeding tray 3*a* by driving, for example, a pickup roller in the feeding mechanism 3*b* piece by piece to the downstream side of the conveying path. Then, the skew of the fed record medium 50 is corrected by the registration roller pair 3*c*, and fed to the conveying unit 10.

The conveying unit 10 provides a conveying member 11 (conveyance mechanism) formed by an endless belt havint a plurality of conveying belt holes 16 between a driven roller 14*b* to which a conveyance information generation unit 13 is connected to a rotation axis and a driving roller 14*a* to which a conveyance drive unit 12 is connected to the rotation axis.

Provided above and inside the conveying member 11 are a platen 15 formed by a plurality of suction holes not illustrated in the attached drawings as penetrating in the Z-axis direction, and a suction fan (not illustrated in the attached drawings) provided below the platen 15.

The conveyance information generation unit 13 is configured by, for example, a rotary encoder. The conveyance drive unit 12 is configured by, for example, a motor driven at an instruction of the control unit 2.

At an instruction of the control unit 2, the conveying unit 10 holds with adsorption the record medium 50 received and conveyed from the feeding unit 3 on the conveying member 11 by the drive of the suction fan, and conveys it to the downstream side of the conveying path by the conveyance drive unit 12 rotating the conveying member 11. In this case, the rotary encoder in the conveyance information generation unit 13 generates a pulse signal corresponding to the amount of movement of the conveying member 11 (record medium 50), and transmits a notification to the control unit 2.

The side end detection unit 4 is configured by a reflective optical line sensor such as a CCD (charge coupled device), a CIS (contact image sensor), etc.

In the present embodiment, as an example, the side end detection unit 4 is configured by arranging in the main scanning direction two line sensors, that is, a left end detection unit 4L (side end detection unit) for detecting the left medium end portion in the direction of conveyance, and a right end detection unit 4R (side end detection unit) for detecting the right medium end portion in the direction of conveyance, as illustrated in FIG. 2B.

The components p1 through p2000 illustrated in FIG. 2B indicate light receiving elements 4*b* described later, and each of the left end detection unit 4L and the right end detection unit 4R has 2000 pixels.

A side end detecting unit 31 drives the side end detection unit 4, and detects side ends 51 (left end 51L, right end 51R) in the main scanning direction of the record medium 50. Then, a side end position determination unit 32 (side end position determination unit) determines a side end position based on the side end detection result. The side end detection and the side end position determination are described later in detail.

The image recording unit 20 is provided with at least one of image recording units 20-1 through 20-*n* (n≥2, n indicates an integer) as a recording device configured by a nozzle string formed by arranging a plurality of nozzles in the X-axis direction orthogonal to the direction of conveyance (Y-axis direction). The nozzle string is configured by, for example, a system of jetting ink stored in a plurality of ink boxes based on the change in capacity by the transform of the piezoelectric member (PZT) provided for each ink box.

The control unit 2 includes at least: non-volatile memory for storing a control program, setting information, etc.; a recording unit 30 configured by volatile memory for storing side end detection result etc.; the side end detecting unit 31 for driving the side end detection unit 4, and the side end position determination unit 32 for determining the side end position from the side end detection result.

In the case of the present embodiment, the side end detecting unit 31 and the side end position determination unit 32 can be realized by, for example, a hardware logical circuit.

Otherwise, as described above, the side end detecting unit 31 and the side end position determination unit 32 can be realized as a part of the function of the control program executed by a computer stored in the recording unit 30 and configuring the control unit 2.

Described below is the recording method for the control unit 2.

The non-volatile memory in the recording unit 30 stores in advance the information corresponding to the interval from the detection position of the medium tip detection unit (not illustrated in the attached drawings) arranged at the upstream side of the conveying path from the side end detection unit 4 to the plurality of nozzle forming positions of the recording units 20-1 through 20-*n* after converting the information into the accumulated value of the number of pulse signals of the rotary encoder in the conveyance information generation unit 13 of the conveying unit 10.

The information corresponding to the interval is explained below with reference to the image recording unit 20-1 as an example. That is, when the tip of the record medium 50 is conveyed from the detection position of the medium tip detection unit (not illustrated in the attached drawings) to the plurality of nozzle forming positions of the image recording unit 20-1, it is the accumulated value of the number of pulse signals generated by the rotary encoder in the conveyance information generation unit 13. Similarly, the information corresponding to the interval from the detection position of the side end detection unit 4 to the plurality of nozzle forming positions of the recording units 20-1 through 20-*n* is stored in advance.

When the accumulated value of the number of pulse signals generated by the rotary encoder in the conveyance information generation unit 13 using as a trigger the detection information obtained by the medium tip detection unit (not illustrated in the attached drawings) detecting the tip of the conveyed record medium 50 matches the accumulated value of the number of pulse signals corresponding to the plurality of nozzle forming positions of the image recording unit 20-1 stored in the non-volatile memory of the control unit 2, the control unit 2 controls the image recording unit 20-1 to perform the recording process.

In this case, from the accumulated value of the number of pulse signals corresponding to the side end detection unit 4 and the plurality of nozzle forming positions of the image recording unit 20-1, the mask range in which no image is formed in the main scanning direction from the position of the side end 51 (right end 51R, left end 51L) of the record medium 50 when the record medium 50 passes immediately below the image recording unit 20-1 is determined.

An upper device 40 is connected through, for example, a LAN etc. as external equipment of the image recording device 1 according to the present embodiment. The upper device 40 corresponds to the computer of the user who allows the image recording device 1 according to the present embodiment to perform the recording process, and notifies the image recording device 1 of the present embodiment of the job information as the information about the recording process.

Described next is the side end detecting unit 31 according to the present embodiment.

Figure 5A:
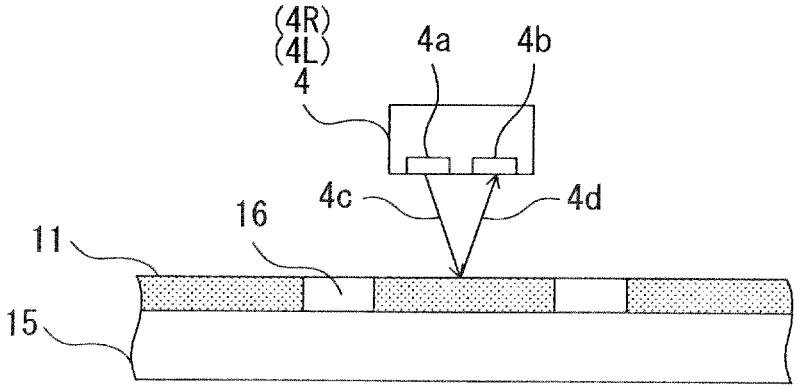
FIG. 5A is a schematic diagram of a side view of the side end detection unit in the image recording device when the unit is detected according to an embodiment of the present invention.

First, as exemplified in FIG. 5A etc., the side end detection unit 4 is configured mainly by an emission unit 4*a* and a light receiving element 4*b* for each pixel, performs an opto-electric conversion on reflected light 4*d* by illumination light 4*c* emitted from the emission unit 4*a* using the light receiving element 4*b* arranged on the line, and sequentially outputs the electric charge accumulated in each light receiving element 4*b* (pixel).

Figure 3:
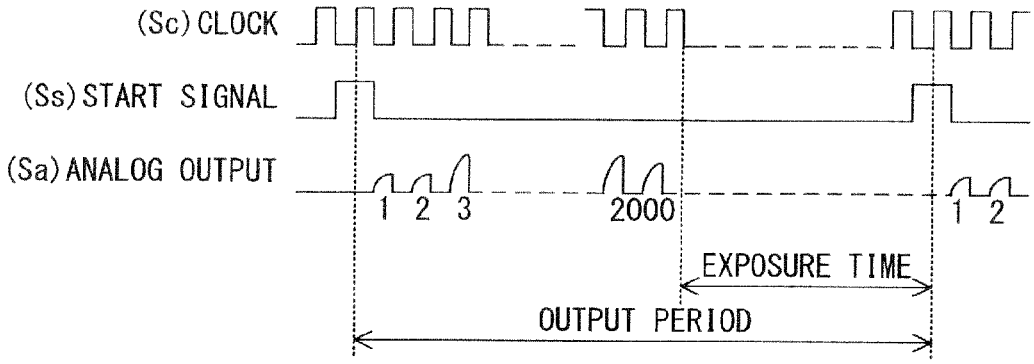
FIG. 3 is a waveform illustrating an example of a general input/output signal of the side end detection unit in the image recording device according to an embodiment of the present invention.

FIG. 3 is a waveform illustrating an example of a general input/output signal of the side end detection unit 4. By the side end detecting unit 31 outputting a clock signal SC and a start signal Ss to the side end detection unit 4, the side end detection unit 4 sequentially outputs the accumulated electric charge in each pixel in order starting with the first pixel. The period from the output of the final pixel to the next start signal Ss is defined as an exposure time (time in which the electric charge is accumulated by the opto-electric conversion).

By the side end detecting unit 31 performing an AD conversion on the analog output Sa of the side end detection unit 4, and comparing the AD value with a threshold α, the side end 51 (right end 51R and left end 51L) of the record medium 50 is detected. As a side end detection result, the pixel exceeding the threshold α at the outermost from a conveyance center 11*a* is obtained. For example, in the left end detection unit 4L, the pixel first exceeding the threshold α is obtained as the result. In the right end detection unit 4R, the last pixel to be lower than the threshold α is obtained as the result.

The results are obtained because the side end 51 of the record medium 50 can be correctly detected even when images of hemming, a background, etc. are formed on the record medium 50 and when images on the reverse are visible.

A misdetection by noise etc. can be prevented by making settings so that M or more pixels in N pixels can exceed (or can be lower than) the threshold α as the decision criterion for the detection of the side end 51. The threshold α is defined as a value between the light receiving level from the record medium 50 and the light receiving level from the conveying member 11. The threshold α can be stored in advance as a value different for each type of the record medium 50, or can be variable depending on the light receiving level.

The side end 51 is detected as described above for each output period T illustrated in FIG. 3, and the side end detection result is latched. The output period T is determined by the characteristic of the side end detection unit 4. The side end detecting unit 31 stores the latched side end detection result in a control table 60 (storage unit) of the recording unit 30 for each amount of conveyance regulated by the conveyance information generation unit 13. Thus, the position of the record medium 50 can correspond to the side end detection result.

Figure 4A:
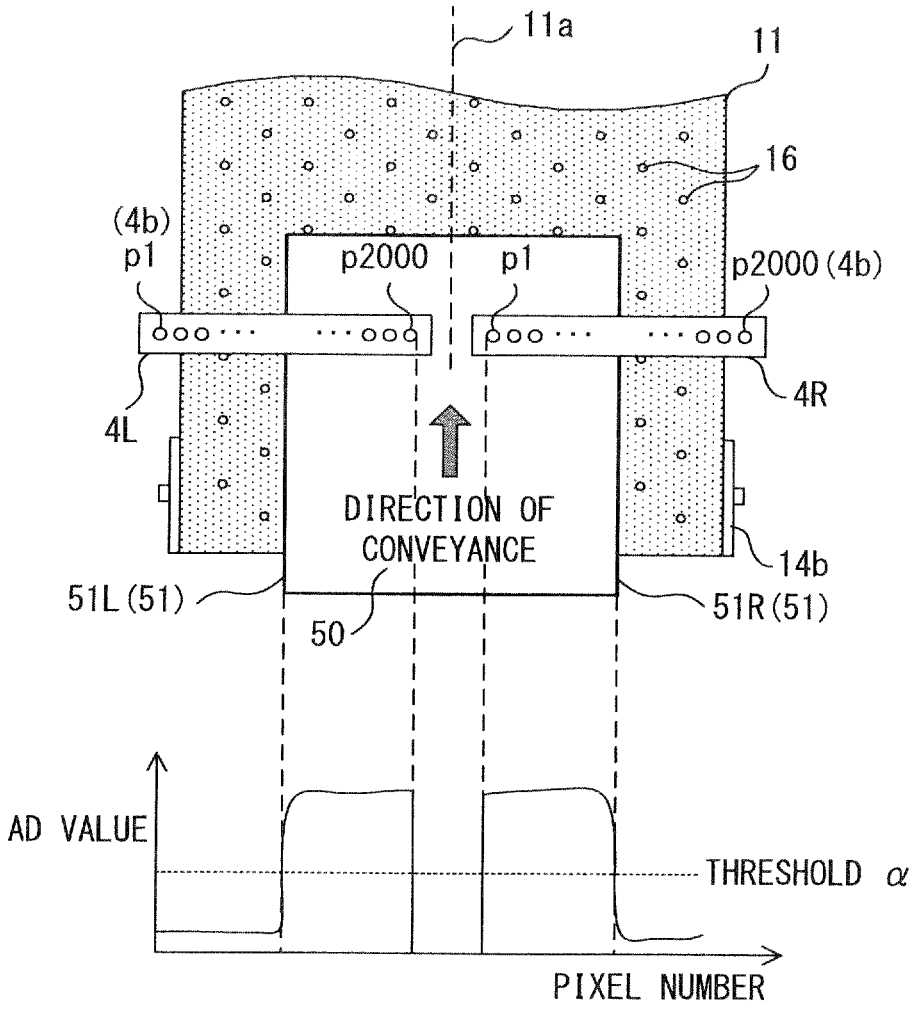
FIG. 4A illustrates the concept of the light receiving level by the side end detection unit in the image recording device according to an embodiment of the present invention, and the arrangement of the record medium at the level.
Figure 4B:
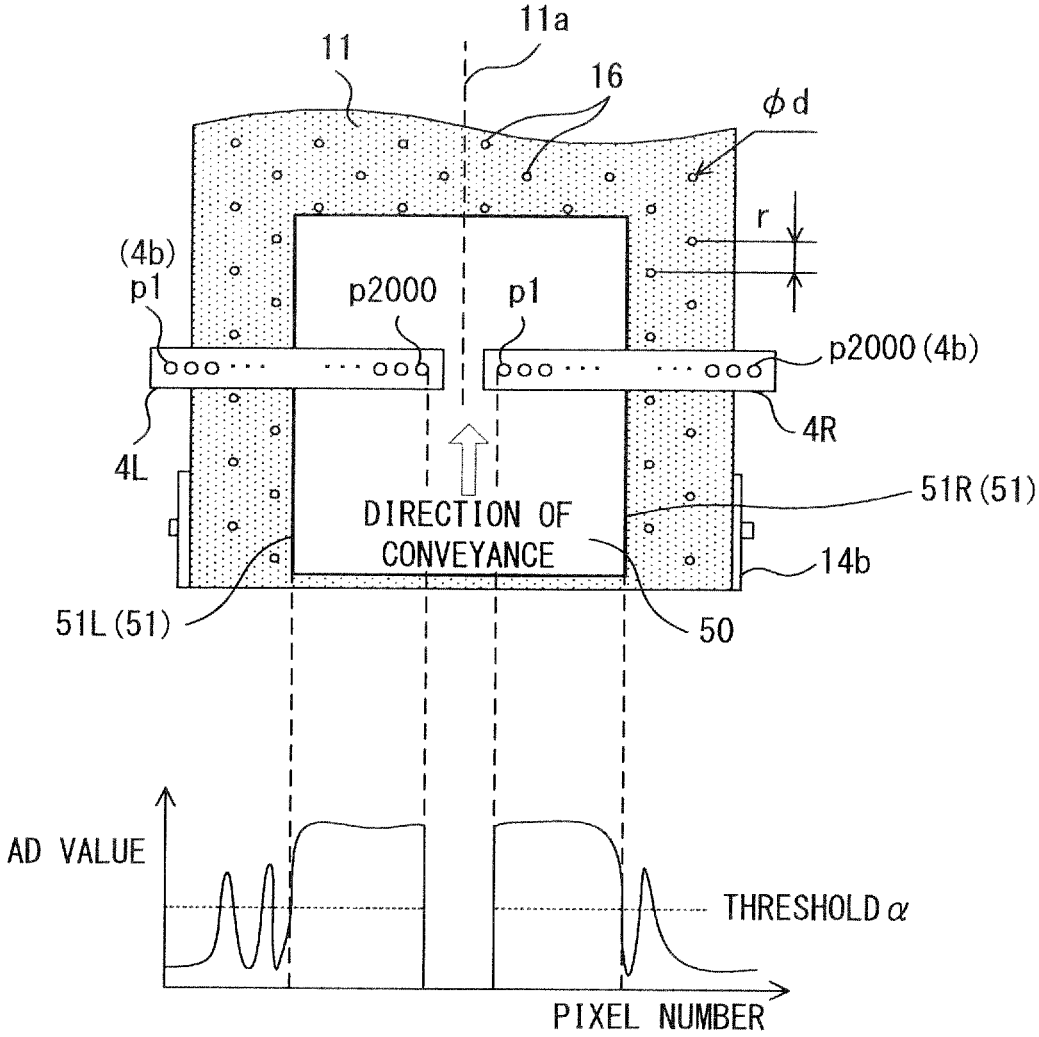
FIG. 4B illustrates the concept of the light receiving leveling an example of a misdetection when it occurs, and the arrangement of the record medium at the level.

FIGS. 4A and 4B illustrate the concept of the light receiving level by the side end detection unit 4 and the arrangement of the record medium 50 at the level.

In this case, the arrangement specification of the conveying belt holes 16 in the conveying member 11 is described below. That is, as an example, the plurality of conveying belt holes 16 of the diameter=ϕd are formed in a zigzag array with the positions shifted in the main scanning direction (X-axis direction) with the pitch of r.

FIG. 4A illustrates the case in which the side end 51 of the record medium 50 can be normally detected, and FIG. 4B illustrates the case in which a misdetection occurs. It refers to a misdetection by the light receiving level of the reflected light from the conveying belt holes 16 exceeding the threshold α.

That is, it is considered that the misdetection has been caused by the arrangement area of the conveying belt holes 16 in the main scanning direction passing immediately below the side end detection unit 4 during the exposure time illustrated in FIG. 3 as described above.

As described above, since the outermost edge is detected as the side end 51 by considering the visible images on the reverse side, the misdetection can be prevented if it is determined that the above-mentioned misdetection result refers to an inappropriate detection result by the alienation from the original conveyance position according to the information about the record medium width detection unit (not illustrated in the attached drawings) in the paper tray and the information about the record medium size set by the user.

However, if the misdetection result approaches the position of the side end 51, it is hard to determine the misdetection.

Figure 5B:
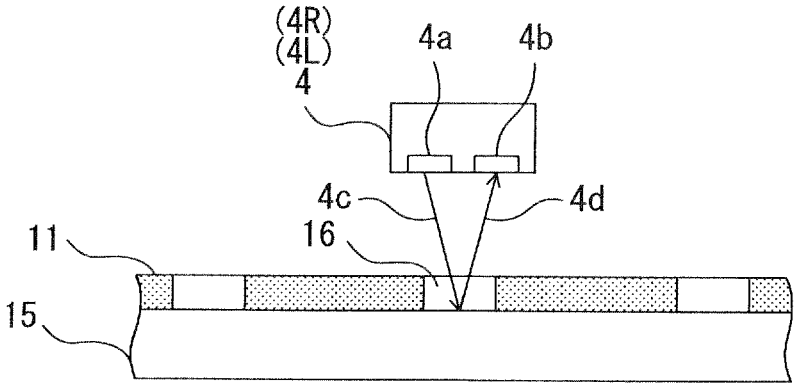
FIG. 5B is a schematic diagram of a side view of the side end detection unit in the image recording device when the unit is detected according to an embodiment of the present invention.
Figure 5C:
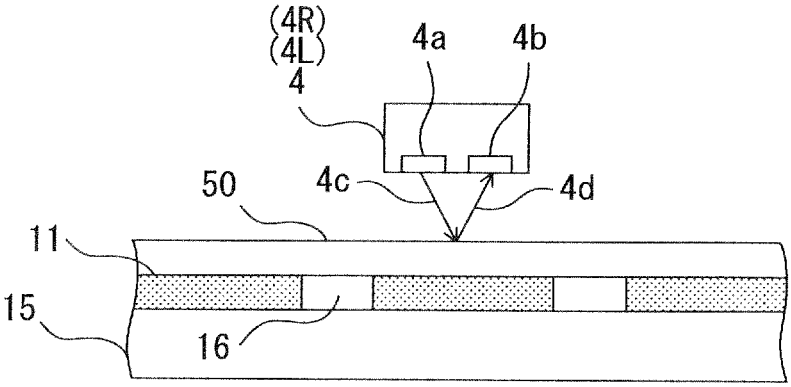
FIG. 5C is a schematic diagram of a side view of the side end detection unit in the image recording device when the unit is detected according to an embodiment of the present invention.

FIGS. 5A, 5B, and 5C are schematic diagrams of the state of the detection by the side end detection unit 4.

FIG. 5A illustrates the state in which the reflected light 4*d* from the flat portion of the conveying member 11 is received. FIG. 5B illustrates the state in which the reflected light 4*d* from the platen 15 is received through the conveying belt holes 16 of the conveying member 11. FIG. 5C illustrates the state in which the reflected light 4*d* from the record medium 50 is received. If the state as illustrated in FIG. 5B occurs outside the record medium, there can be a misdetection with the light receiving level exceeding the threshold α.

Instead of the conveying belt holes 16, foreign substances, stains, scratches, etc. attached to the conveying member 11 can also be the cause for a misdetection.

In the case according to the present embodiment, the side end detecting unit 31 and the side end position determination unit 32 of the control unit 2 excludes the data of the noise outside the side end 51 of the actual record medium 50 illustrated in FIG. 4B as described later, and operates so that the correct position of the record medium 50 can be detected.

Next, the side end position determination unit 32 according to the present embodiment is described with reference to FIG. 6.

FIG. 6 illustrates the concept of an example of the configuration of the control table for storing a side end position detection result in the recording unit 30.

The control table 60 is configured to associate an address 60A with a left end detection result 60L (determination result) and a right end detection result 60R (determination result), and store them.

The address 60A increases for each regulated amount of conveyance of X 0 mm of the record medium 50 corresponding to the position of the direction of conveyance (subscanning direction) of the record medium 50. That is, the pair of the left end detection result 60L and the right end detection result 60R of the record medium 50 is stored at specified intervals of the direction of conveyance of the record medium 50.

The addresses 60A=0~2 and 98~100 having both ends of 0 indicate that the side end 51 was not detected, and the record medium 50 has not reached the position below the side end detection unit 4. As described above, the side end detection result is stored in the recording unit 30 for each regulated amount of conveyance X of 0 mm, and the pair of the left end detection result 60L and the right end detection result 60R is stored in the corresponding address 60A.

For example, assuming that the appropriate side end detection result in FIG. 6 is the 400th pixel at the left end and the 1600th pixel at the right end, the left end detection result 60L stored at the address 60A=5, 8, 91, 94, 97 and the right end detection result 60R stored at the address 60A=4, 7, 10, 92, 97 are misdetection (noise outside the actual side end 51 in FIG. 4B as described above).

When the position of the side end 51 is determined at a certain time point, the side end position determination unit 32 reads the previous (having a smaller address 60A) determination results of N samples before the time point from the control table 60, and determines the position of the side end 51 using an average value obtained by excluding M samples of determination results outside the conveyance center 11*a* (N and M (N>M) are integers).

Described below is the side end position determining method of the left end detection result 60L at the address 60A=10 where N=8 and M=3.

First, from among the left end detection results 60L at the address 60A=10~3, three samples at the 390th, 392nd, and 400th pixels as outer determination results are excluded, the five remaining samples are averaged, and the result is defined as the position of the left end 51L (since each of the 5 samples is formed by 400 pixels in this case, 400 pixels are defined as the position of the left end 51L).

Similarly, from among the right end detection result 60R, three samples at the 1615th, 1613rd, and 1620th pixels as outer determination results are excluded, the five remaining samples are averaged, and the result is defined as the position of the right end 51R (since each of the 5 samples is formed by 1600 pixels in this case, 1600 pixels are defined as the position of the right end 51R).

In the position detection of the left end 51L and the right end 51R at the address 60A=11, the data of the address 60A=11~4 is used and a similar process is performed. Relating to the side end position before the address 60A=9, the side end detection is not performed at the address 60A=0~2. Therefore, the address 60A=10 is defined as the side end position. Thus, the left and right side end positions of the record medium 50 are determined while acquiring a moving average using (N−M) samples.

The number of samples N in this process is determined by the tracking etc. in detecting the requested side end. Assuming that the sampling cycle is X0 [mm], the amount of conveyance for N sampling is X0×N [mm]. If the record medium 50 is conveyed at the maximum of θ degrees with respect to the conveyance center, the side end position is shifted at the maximum of N×N0×tan θ [mm] for N sampling. A value smaller than the minimum width of the margin is the condition for not jetting the ink outside the record medium. That is, if the width or margin is d0, it is necessary to satisfy the following equation.

$$N<d0/(X0\times\tan\theta)$$

(for example, N<14 where X0=2 [mm], θ=1°, d0=0.5 [mm])

Furthermore, if the distance from the side end detection unit 4 to the position up to which the side end position has to be detected (in this case, the distance from the side end detection unit 4 to the image recording unit 20 which is closest to the side end detection unit 4) is d1 [mm], it is also necessary to satisfy the following equation.

$$N<d1/X0$$

(for example, N<15 where X0=2 [mm], d1=30 [mm])

The number M of excluded samples is determined by, for example, the frequency of possible misdetections by the conveying belt holes 16 with the amount of conveyance X0×N [mm] for N sampling. If r [mm] pitches in the direction of conveyance are applied to the conveying belt holes 16, the integer K obtained by raising the decimals of N×X0/r is the number of the conveying belt holes 16 which pass in the direction of conveyance during the N sampling. In this process, if the value obtained by converting the output period T of the side end detection unit 4 into the amount of conveyance is X1 [mm], it is necessary to satisfy M>K when X0<X1.

When X0>X1, it is possible that the same belt hole is misdetected twice. Therefore, the number M of excluded samples has to satisfy, for example, M>2K (practically, it is not always necessary that the value is 2K).

However, if the number of samples (N−M) after the exclusion is too small, there is no averaging effect. Therefore, it may be better that the number M of the excluded samples does not satisfy the relationship above. Practically, although a misdetection result is mixed in the number (N−M) of the samples after the exclusion, the influence of the misdetection can be moderated by the averaging operation. Thus, it is not always necessary to satisfy M>K or M>2K, and it is preferable to determine the appropriate value M from various parameters, the probability of misdetection, etc.

Described next is the side end position determining process by the image recording device 1 according to the present embodiment.

Figure 7:
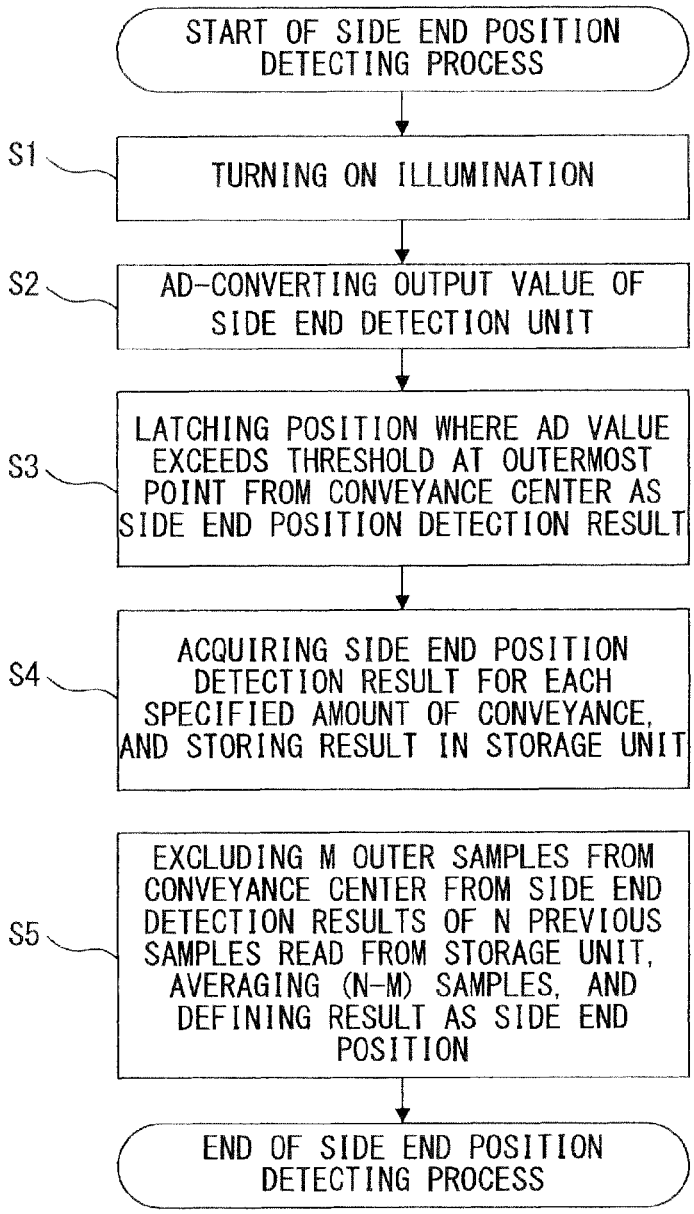
FIG. 7 is a flowchart of an embodiment of the control method of the side end position determining process by the image recording device according to an embodiment of the present invention.

FIG. 7 is a flowchart of the control method of the side end position determining process according to an embodiment of the present invention.

The operating process exemplified by the flowchart in FIG. 7 is realized by the control unit 2 executing the control programs of the side end detecting unit 31, the side end position determination unit 32, etc.

When the process is started as illustrated in FIG. 7, the control unit 2 turns on the emission unit 4*a* of the side end detection unit 4 (left end detection unit 4L, right end detection unit 4R) first in step S1, irradiates the conveying member 11 for conveying the record medium 50 with the illumination light 4*c*, and passes control to step S2.

The control unit 2 AD-converts the output value of each pixel of the side end detection unit 4, and passes control to step S3 (first step).

In step S3, the control unit 2 latches the position where the AD value exceeds the threshold at the outermost point from the conveyance center 11*a* as a side end position determination result (left end detection result 60L, right end detection result 60R) in each of the left end detection unit 4L and the right end detection unit 4R, and passes control to step S4 (second step).

In step S4, the control unit 2 acquires a side end position detection result for each regulated amount of conveyance (pitch), stores it in the corresponding entry of the address 60A of the control table 60 of the recording unit 30, and passes control to step S5 (third step).

In step S5, the control unit 2 averages (N−M) samples by excluding M samples outside the conveyance center 11*a* from the side end detection results (left end detection result 60L, right end detection result 60R) for the previous N samples from the storage unit, determines the obtained value as each position of the left end 51L and the right end 51R, and terminates the present obtaining process.

Then, the control unit 2 controls the recording range in the width (X) direction for the record medium 50 in the image recording unit 20 according to the position information about the left end 51L and the right end 51R of the record medium 50 determined in step S5.

Thus, the image recording device 1 can correctly detect the positions of both of the left end 51L and the right end 51R of the record medium 50 without the influence of the stains, scratches, etc. on the surface of the conveying member 11 of the conveying belt holes 16 exemplified in FIG. 4B, and the noise caused by the hamming, images on the reverse, etc., that is, without the influence of the state of the record medium 50 by averaging the samples by excluding specified M (<N) relatively outer samples from N left end detection result 60L and right end detection result 60R in each direction of right and left with respect to the conveyance center 11*a* of the record medium 50.

That is, in the case of the image recording device 1 according to the present embodiment, although there is a noise source in the conveying member 11, the right and left side end positions of the record medium 50 are not detected outside the actual positions.

As a result, in the image recording unit 20, a malfunction such as jetting ink to the area of the conveying member 11 outside the direction of the width of the record medium 50 is prevented, and the stains of the conveying member 11 can be avoided without fail, thereby reducing the frequency of the maintaining operations of the image recording device 1 and the maintenance cost, and realizing the improvement of the performance.

The present invention is not limited to the above-mentioned embodiments, but can be realized by varying the components within scope of the gist of the present invention in the embodying stages. In addition, the present invention can be realized as various inventions by appropriately combining a plurality of components disclosed in the above-mentioned embodiments. For example, the present invention can delete some components from all components described in the embodiments above, and the components in the different embodiments can be appropriately combined.

For example, the image recording unit 20 is not limited to the configuration for use with ink, but may have other configurations.

Furthermore, the side end detection unit 4, the side end detecting unit 31, and the side end position determination unit 32 can configure the side end position recognition device, and the side end position recognition device can be implemented for another arbitrary device for processing the record medium 50.

In addition, the side end position recognition method for a record medium which is embodied by the side end detection unit 4, the side end detecting unit 31, and the side end position determination unit 32 can be embodied by another arbitrary device for processing the record medium 50.

(Append)

An image recording device having a conveyance mechanism for conveying a record medium, and at least one recording unit configured by a nozzle string formed by a plurality of nozzles in the direction orthogonal to the direction of conveyance of the record medium for performing a recording process on the record medium by jetting ink from the plurality of nozzles includes at least:

a side end detection unit for detecting the side end position of the record medium; a recording unit for storing a detection result of the side end detection unit; and aside end position determination unit for reading N samples of consecutive side end detection results from the storage unit, and defining an average value of N−M samples obtained by excluding M samples outside the conveyance center from the N samples of side end detection results.

What is claimed is:

1. An image recording device, comprising:

a conveyance mechanism moving a record medium in a first direction;

a recording unit having a recording device arranged in a second direction crossing the first direction in which the record medium moves;

a side end detection unit detecting in a desired period a side end position in the second direction of the record medium which moves in the first direction;

a storage unit storing a plurality of detection results of the side end position acquired by the side end detection unit; and a side end position determination unit reading the plurality of continuous detection results from the storage unit, and determining as the side end position of the record medium an average value of the detection results remaining after excluding at least one detection result indicating the side end position at a relatively outside a central portion of the record medium from the plurality of read detection results.

2. The device according to claim 1, wherein the side end position determination unit sequentially determines the side end position at a position different from a position of the record medium in the first direction by calculating a moving average with M (<N) determination results relatively outside from N determination results obtained by shifting a read position from the storage unit as moving in the first direction of the record medium.

3. The device according to claim 1, wherein:

the side end detection unit comprises an emission unit for illuminating the conveyance mechanism, and a light receiving unit for detecting reflected light from the conveyance mechanism, and detects the side end position depending on a difference in amount of reflected light between the conveyance mechanism and the record medium; and the conveyance mechanism includes an endless belt provided with suction holes for adhering to and holding the record medium.

4. A method of controlling an image recording device having a conveyance mechanism for moving a record medium in a first direction and a recording device arranged in a second direction crossing the first direction in which the record medium moves, the method comprising:

a first step of detecting at a desired period a side end position in the second direction of the record medium moving in the first direction;

a second step of storing a plurality of detection results of the side end position acquired in the first step; and a third step of reading the plurality of continuous detection results from the plurality of detection results stored in the second step, and determining as the side end position of the record medium an average value of the detection results remaining after excluding at least one detection result indicating the side end position at a relatively outside a central portion of the record medium from the plurality of read detection results.

5. The method according to claim 4, wherein in the third step, the side end position at a position different from a position of the record medium in the first direction is sequentially determined by calculating a moving average with M (<N) determination results relatively outside from a plurality of N determination results obtained by shifting a read position from the storage unit as moving in the first direction of the record medium.

6. The method according to claim 4, wherein:

the side end position is optically detected in the first step; and the conveyance mechanism includes an endless belt provided with suction holes for adhering to and holding the record medium.

7. A side end position recognition device of a record medium, comprising:

a side end detection unit detecting in a desired period a side end position in a second direction crossing a first direction of a record medium which moves in the first direction by a conveyance mechanism;

a storage unit storing a plurality of detection results of the side end positions acquired by the side end detection unit; and a side end position determination unit reading the plurality of continuous detection results from the storage unit, and determining as the side end position of the record medium an average value of the detection results remaining after excluding at least one detection result indicating the side end position at a relatively outside a central portion of the record medium from the plurality of read detection results.

8. The device according to claim 7, wherein the side end position determination unit sequentially determines the side end position at a position different from a position of the record medium in the first direction by calculating a moving average with M (<N) determination results relatively outside from N determination results obtained by shifting a read position from the storage unit as moving in the first direction of the record medium.

9. The device according to claim 7, wherein:

the side end detection unit comprises an emission unit for illuminating the conveyance mechanism, and a light receiving unit for detecting reflected light from the conveyance mechanism, and detects the side end position depending on a difference in amount of reflected light between the conveyance mechanism and the record medium; and the conveyance mechanism includes an endless belt provided with suction holes for adhering to and holding the record medium.

* * * * *